United States Patent [19]

Walker

[11] Patent Number: 4,886,003

[45] Date of Patent: Dec. 12, 1989

[54] EMBROIDERING TOOL

[76] Inventor: William H. Walker, 3227 Forrest Ave., Gadsden, Ala. 35905

[21] Appl. No.: 309,807

[22] Filed: Feb. 13, 1989

[51] Int. Cl.[4] ..... P05C 15/06

[52] U.S. Cl. ..... 112/80.03; 223/104

[58] Field of Search ..... 66/115, 116, 117, 118; 112/80.03, 80.05; 223/104, 102; 604/224

[56] References Cited

U.S. PATENT DOCUMENTS

| | | | |
|---|---|---|---|
| 983,763 | 2/1911 | Potter et al. | 112/80.03 |
| 1,671,957 | 5/1928 | Kottler | 112/80.05 |
| 3,344,790 | 10/1967 | Dorner | 112/80.03 X |
| 4,306,510 | 12/1981 | O'Brien | 223/104 X |
| 4,479,445 | 10/1984 | Walker | 112/80.05 |

*Primary Examiner*—Ronald Feldbaum
*Attorney, Agent, or Firm*—Donald W. Phillion

[57] ABSTRACT

An embroidering tool comprising first (18), second (23), third (25), and fourth (30) longitudinal and generally cylindrical elements coaxially arranged and each with a longitudinal bore-like cavity (22, 17, 13, and 36) extending therethrough with the first (18) and second (23) elements threadably engagable with each other with the second element (23) comprising a hypodermic type needle (10) and a threaded needle hub (16) with the hypodermic type needle (10) having its proximate end secured in the bore (17) of the needle hub and with the threaded needle hub (16) threadably engagable with a threaded first end (15) of the first element (18), and the third element (25) coaxially surrounding a portion of the first element (18) and being threaded on its inner (31) and outer (33) surfaces beginning at a tapered, compressible first end (48) thereof to allow compression of the third element (25) against the first element (18) to lock the third element (25) against the first element (18) to prevent relative movement between the first (18) and third (25) elements. The fourth coaxial element (30) surrounds portions of the first element (18), the third element (25), the needle (10) and the needle hub (16) and is threadably engagable with the third element (25) from the first end of the third element (25) and further has its bore-like cavity (36) configured to compress the third element (25) against the first element (18) to prevent movement therebetween when the third element (25) is threadably engaged with the first element (18) a predetermined distance, and with the longitudinal position of the third element (25) with respect to the first element (18) determining the amount of extension of the needle (10) out of the fourth element (30) when the fourth element (30) is threadably engaged with the third element (25) by the predetermined distance.

21 Claims, 3 Drawing Sheets

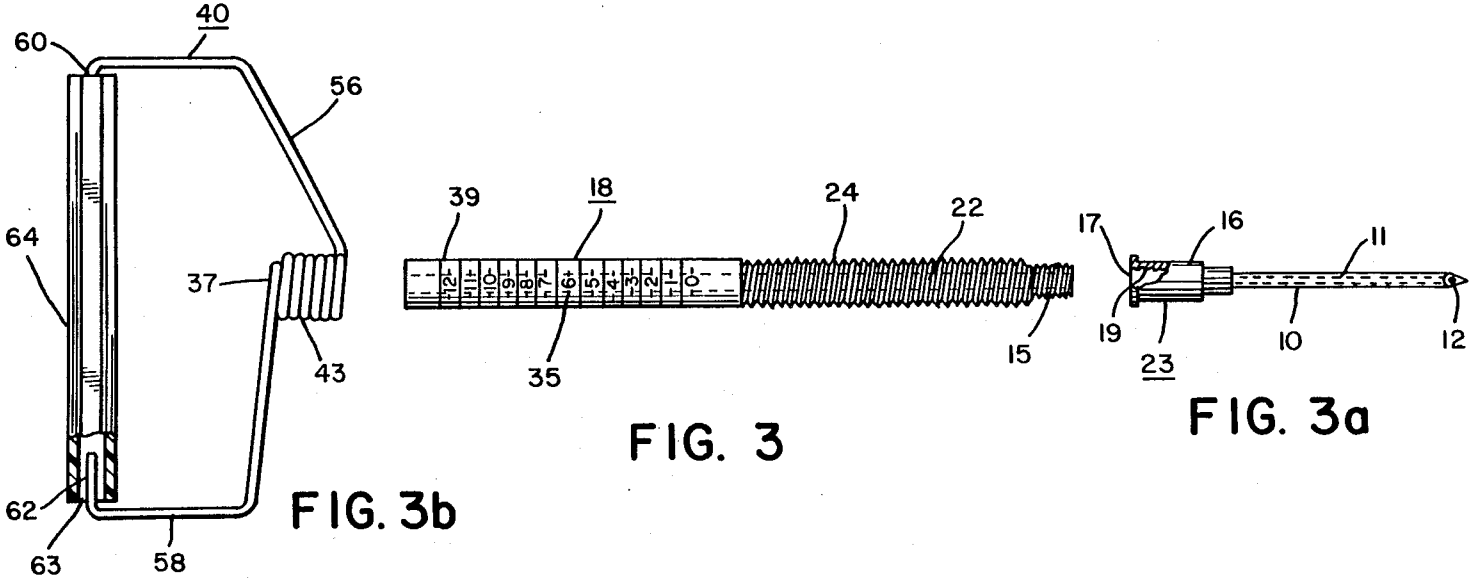
FIG. 3a
FIG. 3
FIG. 3b
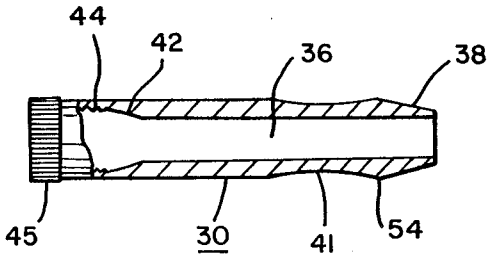
FIG. 3d
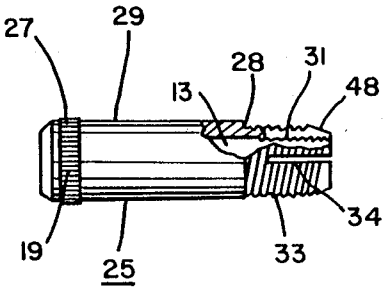
FIG. 3c

EMBROIDERING TOOL

BACKGROUND OF THE INVENTION

This invention relates generally to an improved embroidering tool for use in forming loops of yarn or other material in a basic fabric and more particularly to an improved, all metal, punch embroidering tool in which the length of exposure of the needle can be varied without cutting the yarn or thread.

Embroidering tools of the kind contemplated herein have a tubular needle which is mounted at one end of a finger manipulatable holder therefore. The holder has a bore-like passage therethrough which communicates with the proximal end (nearest end to holder) of the needle so as to accommodate movement of a length of yarn through the holder and into the needle passage or hollow during use of the tool. The distal (far) end of the needle is equipped with a laterally opening eye that communicates with the needle passage. The yarn is threaded through such eye from the needle passage to the exterior of the needle during use of the tool.

In practice, the distal end of the needle is inserted in the back side of the basic fabric and passes through the fabric to a predetermined point from the front side of the fabric before being withdrawn therefrom. Upon initial penetration of the basic fabric, the yarn at the exterior of the needle eye is frictionally engaged by the basic fabric material. As the needle is passed further through the fabric, the yarn length is pulled downwardly through the holder passage and the needle passage until such time as the full hilt of the needle insertion is obtained. Thereafter, as the needle length is withdrawn, a loop is formed at the front side of the basic fabric. As the eye contained distal end portion of the needle is withdrawn from the fabric, the fabric material closes in about the yarn at the opposite ends of the length portion of the yarn forming the loop (which has a length about one-half the length of the needle insertion) so that the loop is thereafter maintained and frictionally held in place by the fabric material that surrounded the needle at the point of insertion and withdrawal. In practice, the insertion and withdrawal procedure is repeated with each point of insertion in the basic fabric being, in most cases, in an area which is proximate to the point of the previous withdrawal of the needle from the basic fabric. U.S. Pat. No. 2,565,135 to Kittener, U.S. Pat. No. 4,135,458 to Samoliov, and U.S. Pat. No. 4,306,510 to O'Brien show typical prior art embroidering tools that employ a hollow needle through which the yarn is drawn during use and further illustrate the procedures involved in the use of such tools. Other embroidering tools and procedures are shown in the following U.S. Pat. Nos.: 1,912,977 to Geerhart, No. 3,240,176 to Morrison, No. 3,938,452 to Windall, and No. 4,765,264 to Burton.

It will be appreciated that the size of the loop formed at the front side of the basic fabric is determined by the depth of penetration of the needle during use and is approximately half such penetration depth. Such loop length is normally determined in those embroidering tools that have a needle and holder which are relatively fixed by the location of the needle eye with respect to the adjacent extremity of the holder. The adjacent end of the holder in such cases serves as a stop that engages the back side of the basic fabric and serves to limit the depth of the needle penetration and thus the size of the loop formed during use. To shorten the depth of the penetration and thus provide an element of variance in the sizes of the loops formed by such tools, small sleeve elements that fit over the needle are sometimes provided by the tool manufactures. These sleeve elements are of differing lengths an, to decrease the depth of penetration, an appropriate sleeve length is selected for placement on the needle in abutting relation to the adjacent and extremity of the holder. The sleeve fits snugly on the needle and, during use, the end of the sleeve which is offset from the end extremity of the holder serves to stop the advancement of the needle into the basic fabric to determine the depth of penetration and thus the size of loop formation.

In some types of punch embroidering tools of the hollow needle type, provisions are made for adjusting the location of the needle along the axis of the holder so that, in effect, a means is provided for adjusting the distance between the stop forming end extremity of the needle holder and the eye at the distal end of the needle. The Kittener, Samoliov and O'Brien patents are illustrative of embroidering tools that are provided with adjustable needle capabilities.

One problem with known punch embroidering tools with adjustable needle capabilities is the inconvenience involved in making the adjustments. In some cases the tool parts must be disassembled and thereafter reassembled to make an adjustment as well as cutting the yarn. Yet another difficulty presented by the prior art is the inconvenience and often uncertainty in duplicating needle adjustments. In some tools there are no convenient provisions for indexing the adjustment to the depth of penetration of the needle. Accordingly, a trial and error approach to duplicating a previous adjustment must be resorted to.

Still another difficulty with known punch embroidering tools with adjustable needle capabilities resides with the manufacturer and involves the excessive costs that are required for manufacturing the known designs. Most prior art embroidery tools of the kind contemplated are used for fine and delicate decorative embroidery work, and require the use of a hollow needle that is usually less than about 2 mm in diameter. Tubular components of this size are incapable of withstanding large lateral pressures without being damaged and are not capable of low cost modification to supply the market demand for tools of the kind contemplated. As such, current manufacturers have resorted to the use of low cost hypodermic or cannulation needle assemblies which are currently being supplied to the medical field for use as components of devices and assemblies that are used in injecting and/or withdrawing fluids from the bodies of humans and other animals. Typical of such devices and components used in making hypodermic injections and withdrawing blood specimens in the subcutaneous tissues of the body. Such needle assemblies are being mass produced in such large quantities for the medical professional as to permit their modification for use as relatively inexpensive components for such embroidery tools. The Samoliov patent is representative of one such use of cannulation needle assembly in an embroidering tool wherein the assembly before incorporation and use in the tool structure may be modified simply by providing an appropriate eye at the distal end of the needle.

Unfortunately, the use of such needle assemblies has been found objectionable by certain governmental bodies and agencies because the tools can be disassembled and the cannulation needle assemblies thereafter used as illegal drug paraphenalia by unauthorized drug users. Accordingly, the need exists for a structural arrangement in a tool of the type contemplated herein that permits the use of a modified cannulation needle assembly but nevertheless effectively precludes the subsequent use of the modified assembly for such unauthorized purposes.

A more recent prior art U.S. Pat. No. 4,479,445 issued to William Walker and entitled Embroidering Tool provides for an adjustable length needle. The prior art U.S. Pat. No. 4,479,445 is formed entirely of plastic except for the needle which is of steel and closely resembles a hypodermic need in that it has a bore extending through the length thereof and with the sharp end of the needle having an eye formed therethrough with one end of the bore terminating openly in the inner perimeter of the eye of the needle. The thread or yarn employed in punch embroidery extends from the spool of thread (or yarn) through the bore of needle and then through the eye of the needle.

The prior art device of U.S. Pat. No. 4,479,445 comprises a first elongated, generally cylindrically shaped plastic element with bore formed axially therethrough and having a tapered end which grips the second end of the needle firmly and permanently so that the needle cannot move laterally with respect to the axis of the first longitudinal element. A portion of the outer surface of the first elongated element is threaded. A second elongated cylindrically shaped plastic element has a bore therethrough having a diameter slightly larger than the diameter of the threaded portion of the first elongated element and formed with a protruding button on the surface of the bore therein. Such button fits within the threads of the threaded portion of the first elongated element and functions as a matching thread with the threaded portion of the first elongated plastic element. Thus, as the second element is rotated with respect to the first element, such second element will move longitudinally with respect to the first element.

The second element also have a tapered end within which the diameter of the bore therethrough becomes increasingly smaller until it is only slightly greater than the diameter of the needle.

The bore at the tapered end of the second element fits closely but loosely around the needle so that as the second element is rotated with respect to the first element and the second element moves freely in either longitudinal direction with respect to the first element such second element will also move longitudinally in either direction with respect to the needle. Thus, the length of the needle extending out of the tapered end of the second element will vary in accordance with the degree and direction of the rotation of the second element with respect to the first element. The exposed length of the needle is important in punch embroidery in that it determines the length of the loop of yarn being formed to produce the desired three dimensional effect.

One of the principal problems encountered with the above-described prior art punch embroidery needle assembly lies in the use of the protruding button on the surface of the bore extending through the second element. Because the button is relatively small and made of plastic it is fragile and relatively soft and tends to wear off with usage, thereby destroying its function as a threaded surface and thus preventing controlled axial movement of the second element with respect to the first element. The exposed length of the needle, therefore, cannot either be accurately controlled or even maintained in a fixed position since the second element can now simply slide axially with respect to the first element and will not be controllable by a relative rotational movement of the second element with respect to the first element.

A further difficulty commonly experienced with punch embroidery type needles of the type described in U.S. Pat. No. 4,479,445, or other prior art devices, is that the needle frequently bends because of the force applied thereto by the user so that the needle occasionally must be replaced. With the prior art tool described above in U.S. Pat. No. 4,479,445 a bent needle requires not only the replacement of the needle but also the replacement of the first plastic element within which the needle is firmly and permanently secured. To replace only the needle and the first plastic element in which the needle is held is tantamount to replacing the entire structure because by the time the needle becomes bent it is quite likely that the small plastic button which acts as a thread in the bore of the second element will probably be well worn down and should also be replaced. Replacement of a prior art punch embroidery needle of the type described above costs about ten dollars retail at the filing date hereof.

It would mark a definite improvement in the art to provide a punch embroidery type needle in which a damaged needle could be easily replaced without replacing any other elements and in which the mechanism for adjusting the length of the exposed portion of the needle has an indefinitely long life without exhibiting appreciable wear or breakdown of any kind.

OBJECTS OF THE INVENTION

A primary object of the invention is to provide a punch embroidery tool in which the mechanism for adjusting the exposed length of the needle is extremely durable and which is otherwise unusually resistant to any kind of breakdown when used in its normal manner.

A second primary object of the invention is to provide a punch embroidery tool in which a damaged needle can be replaced without replacing any other portion of the device.

A third object of the invention is to provide an all metal punch embroidery needle which consists of four major parts screwed together by conventional threaded portions thereof and which can be easily disassembled (as to change the needle), or assembled for use a virtually unlimited number of times without breaking or producing noticeable wear on any of the parts except perhaps the needle, which can easily be replaced as will become apparent from the specification set forth later herein.

Yet another object of the invention is to provide a punch embroidery tool in which a damaged needle can be easily be replaced without any other part of the device and in which the mechanism for accurately and easily adjusting the exposed length of the needle is extremely durable and resistant to any kind of failure.

STATEMENT OF THE INVENTION

In accordance with one preferred embodiment of the invention there is provided an embroidering tool comprising first, second, third, and fourth longitudinal and generally cylindrical elements coaxially arranged with each other and each with a longitudinal bore-like passage extending therethrough, with the first and second elements threadably engagable with each other and with the second element comprising a hypodermic type needle and a threaded needle hub having a bore therethrough with the hypodermic type needle having its proximate end secured in the bore of the needle hub and with the threaded needle hub threadably engagable with a threaded first end of the first element, and the third element coaxially surrounding a portion of the first element and being threaded on its inner and outer surfaces at a compressible first end thereof to allow compression of the first end of the third element against the first element to lock the third element against the first element and thereby to prevent relative movement between the first and third elements. The fourth element coaxially surrounds portions of the first element, the third element, the needle and the needle hub and is threadably engagable with the third element from the first end of the third element and further has its bore-like passage configured to compress the end of the third element against the first element to prevent movement therebetween when the fourth element is threadably engaged with the third element a predetermined distance, and with the longitudinal position of the third element with respect to the first element determining the amount of extension of the needle out of the fourth element when the fourth element is threadably engaged with the third element by the predetermined distance.

BRIEF DESCRIPTION OF THE DRAWINGS

The above and other objects and features of the invention will be more fully understood when read in conjunction with the drawings in which:

FIGS. 3, 3*a*, 3*b*, 3*c*, and 3*d* respectively show the elements 18, 23, 40, 25, and 30 in an exploded type arrangement with the elements 18, 23, 40, 25, and 30 being shown in aligned and/or substantially transversely displaced positions with respect to each other, but which collectively, when assembled together, form the entire assembly of the invention as shown in FIGS. 1, 2, and 4.

DETAILED DESCRIPTION OF THE INVENTION

Figure 1:
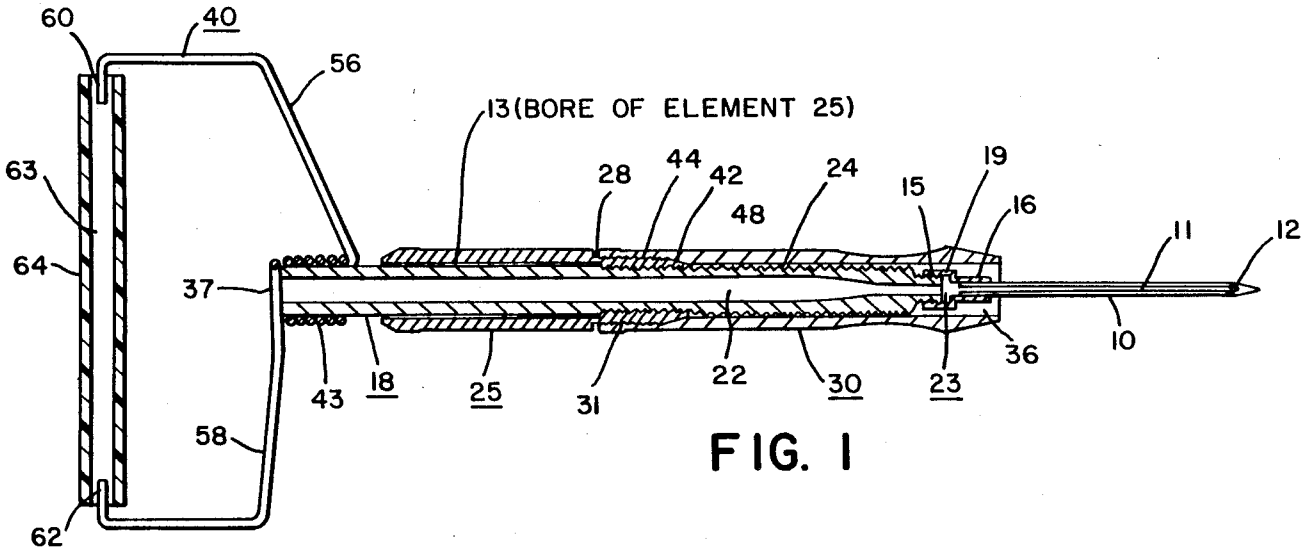
FIG. 1 shows an axial sectional view of the fully assembled invention.

Referring now to FIGS. 1 and 3*a* the needle-needle hub assembly 23 shows the needle 10, having a bore 11 therethrough, which terminates securely in a bored out needle hub 23 with a portion 19 of the bore of the bored out hub 16 being threaded to mate with the threaded reduced diameter portion 15 of the elongated element 18 of FIG. 3, which also has a bore 22 extending therethrough, in such a manner that the bores in element 18, needle hub 23 of FIG. 3*a* and needle 10 are all in axial alignment. The right hand end of bore 22 of element 18 (FIG. 3) narrows to mate smoothly with the bore 11 in needle 10 (FIG. 3*a*).

Approximately one half (the right hand half in FIG. 1) of element 18 has threads 24 formed on its external surface which mate with threads 31 formed within the bore 13 of elongated cylindrical element 25 (see FIGS. 3*c* and 4), as discussed in more detail below.

The bore 13 of cylindrical element 25, which extends longitudinally therethrough, has a diameter which is slightly greater than the outside diameter of the bored-out element 18 of FIG. 3. The right hand end 33 of element 25 is threaded both on its external surface and also within its bore 13. The external diameter of the threaded end 33 of element 25 is slightly less than the left hand end of the unthreaded external surface 29 of element 25 (see FIG. 3) so as to form a shoulder 28 (see FIG. 3*c*) between the threaded portion 33 and unthreaded portion 29 of element 25. It is to be noted that the extreme right hand end of element 25 terminates in a tapered (and slotted) portion 48. As will be discussed in detail later the tapered portion 48 of element 25 is compressed radially inward when the mating tapered portion 42 of the inner bore 36 of element 30 (FIG. 3*d*) is forced thereagainst as element 30 is screwed onto element 25.

Multiple axially oriented slots (not shown in FIG. 1 but represented generally in FIG. 3*c* by the single slot 34) are also formed in the threaded end 33 of element 25 and open onto the right hand end (see FIG. 3*c*) of the threaded portion 33 of element 25.

As will be understood more clearly from the discussion later herein of cylindrical element 25 and its functions, the shoulder 28 and the slots of element 25 cooperate with elongated element 30 (FIG. 3*d*) to secure element 25 firmly in a desired position on element 18, thereby not only determining the length of exposure of needle 10 but also gripping the needle 10 firmly in a manner to prevent significant lateral movement of the needle 10 with respect to the longitudinal position of elements 18, 25, and 30 (FIGS. 3, 3*c*, and 3*d*) which also become firmly positioned with respect to each other.

Referring now specifically to element 30 of FIG. 3*d*, which has a bore 36 extending axially therethrough, it will be noted that both the outer surface 41 and the inner bore surface 41 of element 30 both have non-linear longitudinal contours. Consider first the function of the surface configuration of the inner bore surface 42. The threaded bore portion 44 of the left hand end of element 30 of FIG. 3*d* is threaded to mate with the external threaded right hand end 33 of element 25 of FIG. 3*c* and, when fully mated with external threaded portion 33 of element 25, will butt against the shoulder 28 thereof. It will be noted, as mentioned above, that the extreme right hand end portion 48 of element 25 is tapered in a manner as to have an increasingly smaller external diameter and is not threaded. Further, the surface of the portion 42 of the inner bore 36 of element 30, which is adjacent the right hand end of the threaded portion 44 thereof, also has an increasingly smaller diameter to provide a tapered cylindrical surface which presses against the external tapered cylindrical surface 48 of element 25, thereby forcing the tapered portion 48 of element 25 including the slotted portion of element 25 firmly against the element 18 of FIG. 3.

Thus, by the cooperative action of the slotted, threaded, and tapered portions of element 25 and the tapered portion 42 of element 30 as the two elements 30 and 25 are screwed together, a firm, snug connection is made therebetween which will not work loose as the assembly is used by a person performing punch embroidering, but which can be easily adjusted by the person using the assembly if a different needle exposure is desired or disassembled if the needle 10 is to be replaced.

The externally threaded right hand end 15 (in FIGS. 1 and 3) of the element 18 has a sufficiently reduced diameter to allow the threaded end 15 of element 18 to threadably mate with the threaded bore 19 of needle hub 23 so that the diameter of the external surface 16 of needle hub 23 will not be greater than the diameter of the larger threaded external surface of element 18 (FIG. 3), with the result that the needle 10 can have its greatest possible exposure. More specifically, the outside diameter of element 18 is sufficiently greater than the outside diameter of the thin walled narrowed diameter portion 52 of the bored needle hub 23 so that the elements 25 and 30 can move axially along element 18 to adjust the exposure of needle 10 to be desired length without being obstructed by the needle hub 16.

The needle 10 of FIG. 3*a* is securely mounted in needle hub 16 which in turn is mounted securely (and removably) on the narrowed diameter end 15 of element 18, which, in turn, is rigidly secured to elements 25 and 18, thus assuring minimum lateral movement of needle 10 when being used. The external longitudinal configuration of element 30 of FIG. 3*d* is designed to enable the user to easily grip the entire assembly of FIG. 1 with the enlarged diameter portion 54 (see FIGS. 2 and 3*d*) decreasing to a smaller diameter (concave) portion 33 of element 30 to provide a comfortable grip for the user and to prevent the user's fingers from slipping off the end of element 30 as the needle 10 is forcibly moved downwardly (to the right in FIG. 1) to pierce the material upon which the punch embroidery is being done. The right hand end 38 of element 30 (FIG. 3*d*) is tapered radially inward to allow the user to better view the work being done.

It can be seen that a bore for the thread or yarn extends completely through the entire assembly of FIG. 1 beginning with the bore 22 of element 18 and extending through element 18, and then continuing through bore 17 of needle hub 23 and bore 11 of needle 10.

A device 40 (FIGS. 1, 2, and 3*b*) is provided for holding a spool of thread or yarn. The device 40 can consist of a short, helically shaped wire element 43 which can essentially friction fit around the outside surface of the left end 39 of element 18 rather than within the bore 22 of element 18, as is currently practiced in prior art punch embroidery needle assemblies, thus leaving a larger bore 22 through which the thread or yarn must pass.

The inner surface of the helical portion 43 (FIG. 3*b*) presents a quasi-threaded surface to the left end of element 18 and in effect, can be screwed thereon. The end coil 37 of helical portion 43 has a smaller diameter so that the helical element 43 cannot be screwed or forced over the extreme left and 39 of element 23. It can be seen that by pulling apart the turned-in-wire-like elements 60 and 62 the roller 64, which has a bore 63 therethrough, can be removed to remove a spool (not shown) therefrom or to mount a spool thereon and then remount the roller 64 between the turned-in wire-like elements 60 and 62. The cross-sectional shape of the outer surface of roller 64 preferably is a polygon, such as a rectangle, a hexagon, an octagon or the like to prevent free wheeling or spinning of the thread or yarn.

All of the elements of the completed device preferably are formed of a lightweight aluminum alloy, such as aircraft aluminum, except the needle 10, the wire bracket 40, and the spool holder 64, which can be, respectively, made of steel, a spring like metal, and plastic.

Aircraft aluminum is a generic term covering a multiplicity of one or more of other alloying metals including, among others, titanium, copper, chromium, magnesium, or zinc, in various proportions depending upon the desired use of the resulting alloy.

Most aircraft aluminum alloys are about 40% less in weight than other types of aluminum (non-aircraft) generally employed for industrial uses and has considerably more strength and wear resistance than the more generally used and less expensive commercial aluminum alloys.

Figure 2:
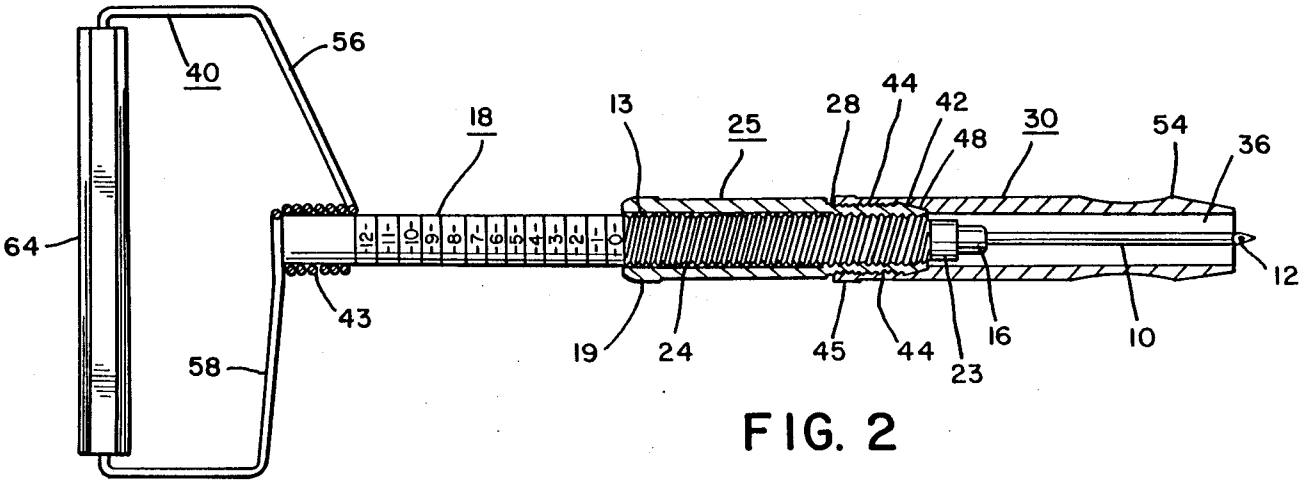
FIG. 2 shows an axial sectional view of the fully assembled invention but with the exposure of the needle less than that of FIG. 1.

FIG. 2 is similar to FIG. 1 but shows the elements 25 and 30 moved to the right with respect to the element 18 to produce a shorter exposure of needle 10.

To change the needle exposure the following procedure can be employed. The element 30 is first unscrewed a short distance from element 25 to unlock elements 25 and 30 from each other. Then, both elements 25 and 30 can be moved in either direction on element 18 by hand turning knurled portions 19 and 45 a distance equal to the distance that the needle exposure is to be lengthened or shortened while holding element 18 in place. The element 25 is then screwed back onto element 30 until it abuts against shoulder 28 (FIG. 3*c*) of element 25 to lock elements 25 and 30 together.

It is to be noted that a scale 0 through 12 (reference character 27) is formed on the side of the left hand end of element 18 with the distance between each numeral representing a desired difference of needle exposure such as 3/16", for example. A series of horizontal lines also can be formed on the surface of the element 18 adjacent and between the numeric scale 27 to further refine the distance of needle exposure, in the manner a micrometer is marked, for example. As elements 30 and 25 are moved along element 18 a different numeral and/or horizontal line will be exposed next to element 25 indicating the total amount of needle exposure.

Referring again to FIGS. 3, 3*a*, 3*b*, 3*c*, and 3*d*, the various parts of the total assembly of the invention are shown separately including needle 10 and its hub 23 assembly (FIG. 3*a*). The threaded bore portion 19 of needle hub 16 screws onto the threaded, narrowed diameter 15 of the elongated element 18 (FIG. 3), which is also threaded on its larger diameter external portion 24.

The bored out element 25 (FIG. 3*c*), threaded both on its external surface 24 and in its bore 36, mates its threaded bore surface 31 with the threaded outer surface 24 of element 18 (FIG. 3).

The tapered bore surface 42 of elements 30 slips over the slotted and tapered end 48 of element 25 so as that when the threaded end 44 of element 30 is fully screwed onto the threaded portion 33 of element 25 the tapered portion 42 of the bore 36 of element 30 will press onto the tapered and slotted end 48 of element 25, thereby forming a firm, snug connection between elements 30, 25, and 18, with the left hand end of element 30 abutting against the shoulder 28 of element 25.

There are typically four slots, such as the slot 34 shown in the right hand threaded and tapered end 33 and 48 of element 25 of FIG. 3*c*. These slots allow a radial, spring-like compression of the tapered end of element 25 as element 30 (FIG. 3*d*) is screwed thereon to fit snugly against the shoulder 28 of FIG. 3*c*.

Figure 4:
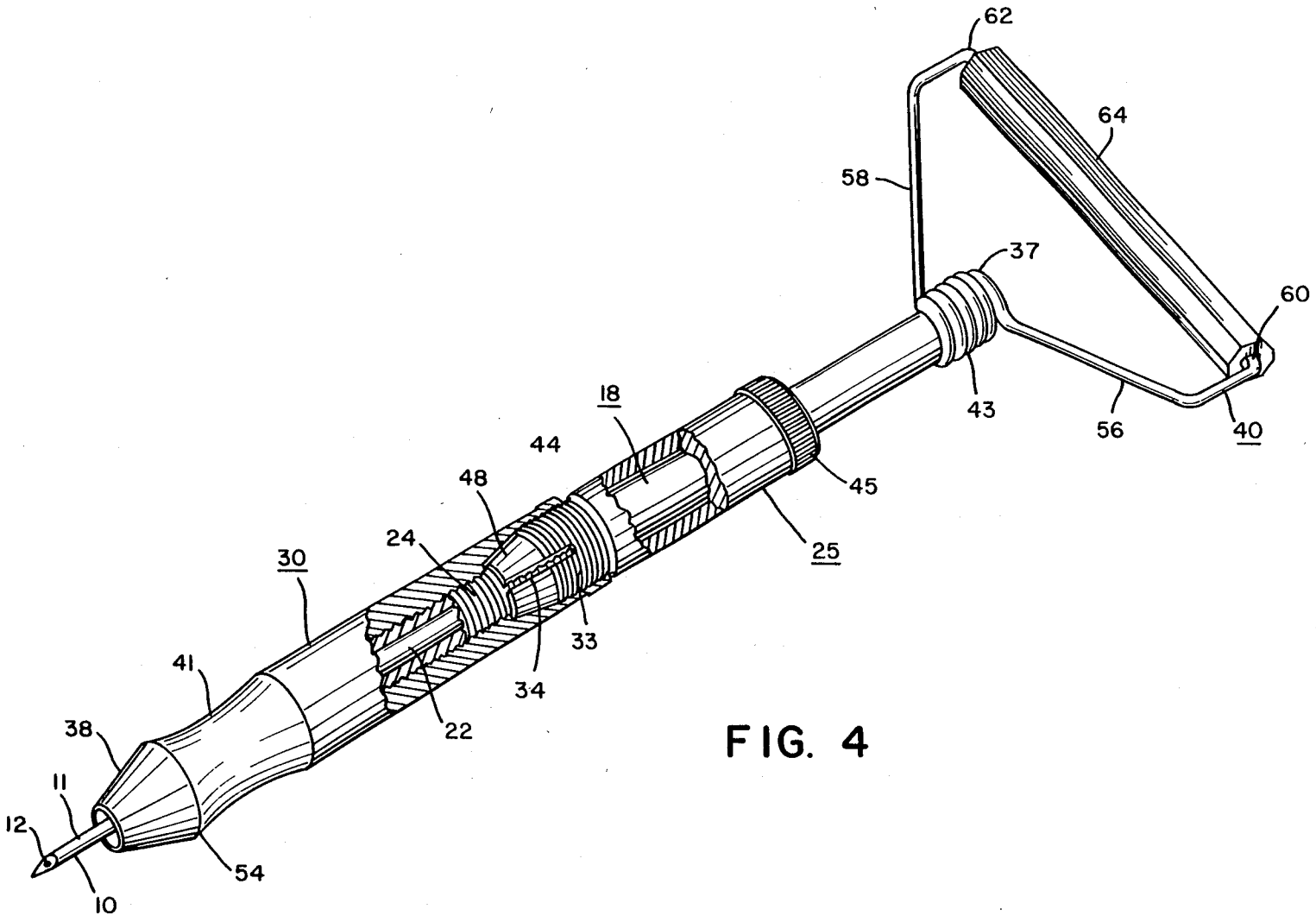
FIG. 4 illustrates an isometric view of the assembled invention with parts thereof broken away for purposes of showing more clearly certain inner elements and their relation to each other.

Referring now FIG. 4 there is shown an isometric view of the invention with a portion thereof broken away to show the internal connections of some of the elements e.g. elements 18, 25 and 30. Corresponding elements of the various figures are identified by the same referenced characters.

To thread the device, the thread is first inserted through the bore 22 of element 18 from the left end of element 18, then through the bore 11 of needle 10, and finally through the eye 12 of needle 10 from the concave side of the needle point of needle 10.

It is to be understood that the form of the invention shown and described herein is but one preferred embodiment thereof and that various changes therein and forms thereof can be designed by one of ordinary skill in the art without departing from the spirit or scope of the invention as defined in the appended claims. For example, helical coil 43 can be a snugly fitting slotted cylinder with one end closed and the slotted and tapered end 48 of element 25 can be of any suitable compressible configuration.

I claim:

1. An embroidering tool comprising:

first, second, third, and fourth longitudinal and generally cylindrical elements coaxially arranged and each with a longitudinal bore-like cavity extending therethrough;

said first and second elements threadably engagable with each other with said second element comprising a hypodermic type needle and a threaded needle hub with said hypodermic type needle having its proximate end secured in the bore of said needle hub and with said threaded needle hub threadably engagable with a threaded first end of said first element;

said third element coaxially surrounding a portion of said first element and being threaded on its inner and outer surfaces beginning at a radially compressible first end thereof to allow compression of said third element against said first element to lock said third element against said first element to prevent relative movement between said first and third elements; and said fourth element coaxially surrounding portions of said first element, said third element, said needle, and said needle hub and threadably engagable with said third element from said first end of said third element and further having its bore-like cavity configured to compress the radially compressible first end of said third element against said first element to prevent movement therebetween when said fourth element is threadably engaged with said third element to a predetermined point on said third element;

the longitudinal position of said third element with respect to said first element determining the amount of extension of said needle out of said fourth element when said fourth element is threadably engaged with said third element by said predetermined distance.

2. An embroidering tool as in claim 1 in which said predetermined point on said third element comprises a portion of said third element having a diameter greater than the diameter of the threaded portion on the outer surface of said third element.

3. An embroidering tool as in claim 1 in which the diameter of the inner bore of that portion of said fourth element which surrounds said needle hub and said needle is greater than the diameter of any portion of said needle hub or said needle.

4. An embroidering tool as in claim 1 and further comprising a spool holder, said spool holder comprising:

a fifth, generally cylindrical element frictionally positioned around the second end of said first element;

first and second wire-like elements of a spring-like material extending in opposite directions from opposite sides of said fifth cylindrical element and shaped to form an incomplete generally rectangularly shaped structure with a section omitted between the said first and second wire-like elements as they turn to complete said rectangularly shaped structure, leaving two short sections of said wire-like elements pointed generally at each other with a gap therebetween; and a roller with a bore extending therethrough and having a length greater than said gap between said two short sections of said wire-like elements and insertable between, or removable from, said two short sections of wire-like material because of the spring-like nature of said first and second wire-like elements.

5. An embroidering tool as in claim 4 in which:

said fifth, generally cylindrical element comprises a helically wound section of spring-like wire forming a cylindrical coil whose inner diameter is slightly less than the diameter of the second end of said first element; and in which said first and second wire-like elements are extensions of opposite ends of said helically wound coil.

6. An embroidering tool as in claim 5 in which the coil of said helically wound coil farthest removed from the end of said first element has a diameter which is substantially less than the diameter of said first element and cannot, therefore, be placed around said first element, thus limiting the distance said helical coil can be positioned along the end length of said first element.

7. An embroidering tool as in claim 1 in which the exterior surface of said fourth element has an axial profile, beginning at the needle end, which tapers markedly to a larger diameter and then tapers less markedly to a smaller diameter, and then tapers through increasingly greater diameters to a substantially constant diameter, to provide the user with a surface that enables the punching operation to be effected comfortably without the user's fingers slipping off the end of the tool.

8. A punch embroidering tool comprising:

first, second, third, and fourth longitudinal and generally cylindrical elements coaxially arranged and each with a longitudinal bore-like passageway extending therethrough;

said first element comprising a threaded portion on its outer surface and including a threaded first end;

said second element comprising a hypodermic type needle and a needle hub, both having bore-like passageways extending therethrough, with the proximate end of said needle being secured within a first portion of the bore-like passageway of said needle hub and with a second portion of the bore-like passageway of said needle hub being threaded to threadably engage the threaded first end of said first element;

said third element surrounding a portion of said first element and being threaded on both its inner and outer surfaces and with a first end thereof being flexible and tapered towards said first element to allow compression of said third element against said first element to lock said third element against said first element to prevent relative movement of said first and third elements when said tapered end of said third element is compressed; and said fourth element surrounding portions of said first and third elements, said needle hub, and said needle and threadably engagable with the third element near the tapered first end of said third element to a predetermined point on said third element with the bore-like passageway of said fourth element being shaped to compress the tapered end of said third element against said first element when said fourth element is fully threadably engaged with said third element to said predetermined point on said third element to prevent relative motion of said first, third, and fourth elements with respect to each other and with the longitudinal position of said third element with respect to said first element determining the amount of extension of said needle out of said fourth element.

9. A punch embroidering tool as in claim 8 in which said predetermined point on said third element comprises a portion of said third element having a diameter greater than the diameter of the threaded portion on the external surface of said third element.

10. A punch embroidering tool as in claim 8 in which the diameter of the inner bore of that portion of said fourth element which surrounds said needle hub and said needle is greater than the diameter of any portion of said needle hub or said needle, thus enabling said needle to extend out of the end of said fourth element the full length of said needle when said third element is suitably positioned on said first element and said fourth element is engaged with said third element to said predetermined point on said third element.

11. A punch embroidering tool as in claim 8 and further comprising a spool holder: said spool holder comprising:

a fifth, generally cylindrical element frictionally positioned around the second end of said first element;

first and second wire-like elements of a spring-like material extending in opposite directions from opposite sides of said cylindrical element and shaped to form an incomplete generally rectangularly shaped structure with a section omitted between the said first and second wire-like elements as they are turned towards each other to complete said rectangularly shaped structure, leaving two short sections of said wire-like elements pointed at each other with a gap therebetween, and a roller with a bore therethrough and having a length greater than said gap between said two short sections of said wire-like elements and insertable between, or removable from, said two short sections of wire-like material due to the spring-like nature of said first and second wire-like elements.

12. A punch embroidering tool as in claim 11 in which:

said generally cylindrical element comprises a helically wound section of spring-like wire forming a cylindrical coil whose inner diameter is slightly less than the diameter of the second end of said first element; and in which said first and second wire-like elements are extensions of opposite ends of said helically wound coil.

13. A punch embroidering tool as in claim 12 in which the coil of said helically wound coil farthest removed from the end of said first element has a diameter which is substantially less than the diameter of said first element and cannot, therefore, be placed around said first element and therefore limits the distance said helical coil can be positioned along the end length of said first element.

14. An embroidering tool as in claim 8 in which the exterior surface of said fourth element has an axial profile, beginning at the needle end, which tapers markedly to a larger diameter and then tapers to a smaller diameter, and then tapers with increasingly greater diameter to a substantially constant diameter, to provide the user with a surface that enables the punching operation to be effected comfortably without the user's fingers slipping off the end of the tool.

15. A punch embroidering tool comprising:

a needle hub with a bore therethrough and threaded at a first end;

a hypodermic type needle having a bore therethrough and having a first end thereof secured within a first end of the bore of said needle hub;

first, second, and third elongated threaded elements each having bore-like passageways extending therethrough and arranged coaxially with said second element positioned concentrically around and threadably engaged with said first element, and said third element positioned concentrically around and threadably engaged with said second element, and further with said first element threadably engaged with said needle hub with the bore-like passageways of said needle, said needle hub, and said first element being continuous and axially aligned;

said second element having the first end thereof nearest said needle being compressible towards said first element and, when compressed, will compress said first end of said second element onto the surface of said first element to prevent any relative movement between said first and second elements.

said third element being threadably movable in an axial direction with respect to said second element when rotated with respect to said second element and further having an axially contoured surface in its bore-like passageway to compress said compressible first end of said second element upon said first element to prevent relative motion between any of said first, second, and third elements when said third element reaches a predetermined point on said second element.

16. A punch embroidering tool as in claim 15 in which said predetermined point on said second element comprises a shoulder on said third element having a diameter greater than the diameter of the threaded portion on the external surface of said third element.

17. A punch embroidering tool as in claim 15 in which the diameter of the inner bore of that portion of said third element which surrounds said needle hub and said needle is greater than the diameter of any portion of said needle hub or said element.

18. A punch embroidering tool as in claim 15 and further comprising a spool holder; said spool holder comprising:

a generally cylindrical element frictionally positioned around the second end of said first element;

first and second wire-like elements of a spring-like material extending in opposite directions from opposite sides of said cylindrical element and shaped to form an incomplete generally rectangularly shaped structure with a section omitted between the said first and second wire-like elements as they are turned towards each other to complete said rectangularly shaped structure leaving two short sections of said wire-like elements pointed at each other with a gap therebetween; and a roller with a bore therethrough and having a length greater than said gap between said two short sections of said wire-like elements and insertable between, or removable from, said two short sections of wire-like material because of the spring-like nature of said first and second wire-like elements.

19. A punch embroidering tool as in claim 18 in which:

said generally cylindrical element comprises a helically wound section of spring-like wire forming a cylindrical coil whose inner diameter is slightly less than the diameter of the second end of said first element; and in which said first and second wire-like elements are extensions of opposite ends of said helically wound coil.

20. A punch embroidering tool as in claim 19 in which the coil of said helically wound coil farthest removed from the end of said first element has a diameter which is substantially less than the diameter of said first element and cannot, therefore, be placed around said first element and will, therefore, limit the distance said helical coil can be positioned along the length of said first element.

21. An embroidering tool as in claim 15 in which the exterior surface of said fourth element has an axial profile, beginning at the needle end, which tapers markedly to a larger diameter and then tapers to a smaller diameter, and then gradually tapers with increasing diameter to a substantially constant diameter, to provide the user with a surface that enables the punching operation to be effected comfortably without the user's fingers slipping off the end of the tool.

* * * * *